US007040392B2

(12) United States Patent
Tessier et al.

(10) Patent No.: US 7,040,392 B2
(45) Date of Patent: May 9, 2006

(54) BEARING ASSEMBLY FOR A PROGRESSIVE CAVITY PUMP AND SYSTEM FOR LIQUID LOWER ZONE DISPOSAL

(75) Inventors: Lynn P. Tessier, Cochrane (CA); James L. Weber, Calgary (CA); John P. Doyle, Calgary (CA)

(73) Assignee: MSI Machineering Solutions Inc., Providenciales (TC)

( * ) Notice: Subject to any disclaimer, the term of this patent is extended or adjusted under 35 U.S.C. 154(b) by 121 days.

(21) Appl. No.: 10/651,609

(22) Filed: Aug. 28, 2003

(65) Prior Publication Data

US 2004/0131480 A1 Jul. 8, 2004

Related U.S. Application Data

(60) Provisional application No. 60/406,338, filed on Aug. 28, 2002.

(51) Int. Cl.
*E21B 43/00* (2006.01)

(52) U.S. Cl. ..... 166/68.5; 166/105; 166/313; 418/48

(58) Field of Classification Search ..... 166/313, 166/106, 105.5, 105, 305.1, 311, 68.5; 417/360, 417/423.12; 418/48
See application file for complete search history.

(56) References Cited

U.S. PATENT DOCUMENTS 2,739,650 A * 3/1956 Hill ..... 166/106
3,703,104 A 11/1972 Tamplen
4,293,146 A 10/1981 Beynet et al.
4,676,725 A * 6/1987 Eppink ..... 418/48
4,700,778 A 10/1987 Smith et al.
4,738,599 A 4/1988 Shilling
4,799,546 A 1/1989 Hensley et al.
5,009,265 A 4/1991 Bailey et al.
5,058,683 A 10/1991 Godfrey et al.
5,501,580 A * 3/1996 Barrus et al. ..... 417/410.3
5,590,714 A 1/1997 Van Steenwyk et al.
5,730,871 A * 3/1998 Kennedy et al. ..... 166/265
5,857,710 A 1/1999 Leising et al.
5,988,992 A * 11/1999 Tetzlaff et al. ..... 417/360
6,003,621 A 12/1999 Murray
6,131,663 A 10/2000 Henley et al.
6,247,541 B1 6/2001 Ellis et al.

(Continued)

FOREIGN PATENT DOCUMENTS

CA 2208725 5/2001

OTHER PUBLICATIONS

"Managing Produced Water" by Lang, State-of-the-Art Technology Summary from PTTC Nmetwork New vol. 6, No. 4, 4th Quarter 2000, 5 pages.

(Continued)

*Primary Examiner*—Kenneth Thompson
(74) *Attorney, Agent, or Firm*—Sheridan Ross P.C.

(57) ABSTRACT

A progressive cavity pump pumps liquid downhole to a lower formation past a packer set in a casing of a wellbore. The rotor of the pump is axially restrained by a bearing assembly spaced below the pump for controlling uphole reactive loading on the rotor. Preferably the rotor is releasably coupled to the bearing assembly for release and recovery of the rotor from the bearing assembly. Such a releasable coupling is a latch comprising a plunger telescopically and releasably coupled with a housing using a dog and track arrangement, the dog and track utilizing the telescoping action to actuate the coupling and releasing of the latch.

17 Claims, 15 Drawing Sheets

U.S. PATENT DOCUMENTS

| | | | | |
|---|---|---|---|---|
| 6,510,899 | B1 | 1/2003 | Sheiretov et al. | |
| 6,886,636 | B1 * | 5/2005 | Michael et al. | 166/313 |

OTHER PUBLICATIONS http://www.frtr.gov/matrix2/section4/457.html, Oct. 4, 2001, 4 pages.

http://www.frtr.gov/matrix2/section4/457.gif, Oct. 4, 2001, 1 page.

Harbison-Fischer Ltd. Publication on rod pumps, Nov. 1985, 3 pages.

High-Performance *SEALOL*® Edge-Welded Metal Bellows Seals, John Crane, 7 pages.

* cited by examiner 14
40
1
1

2
2
60
63
61
15b 62
50a
50b
41
53
44
14
45
42
43
47
46
41
51
52
54

Fig. 9a
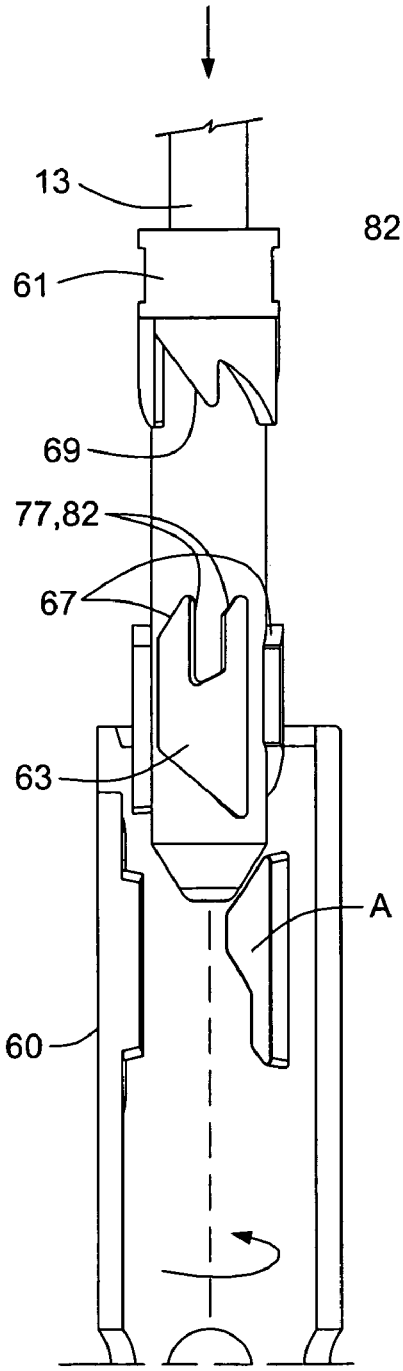
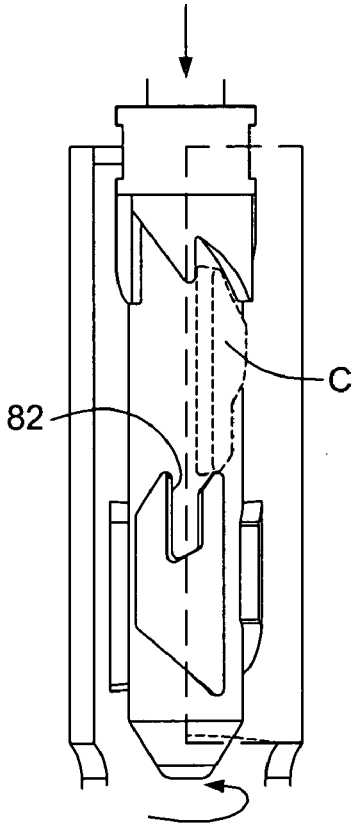
Fig. 9b
Fig. 9c
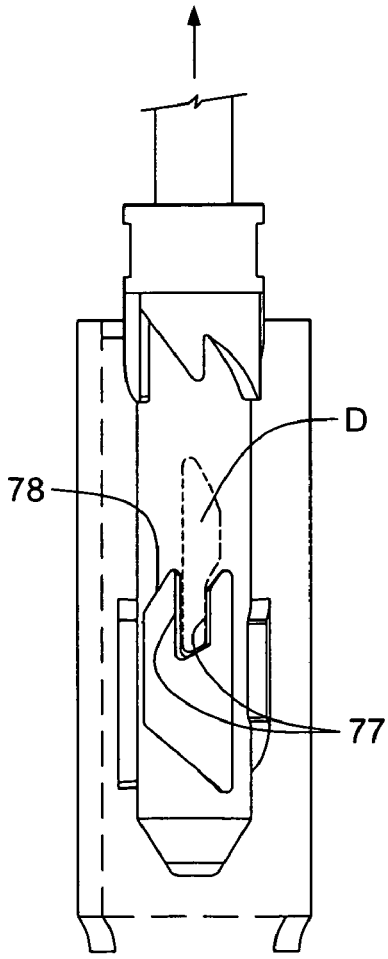

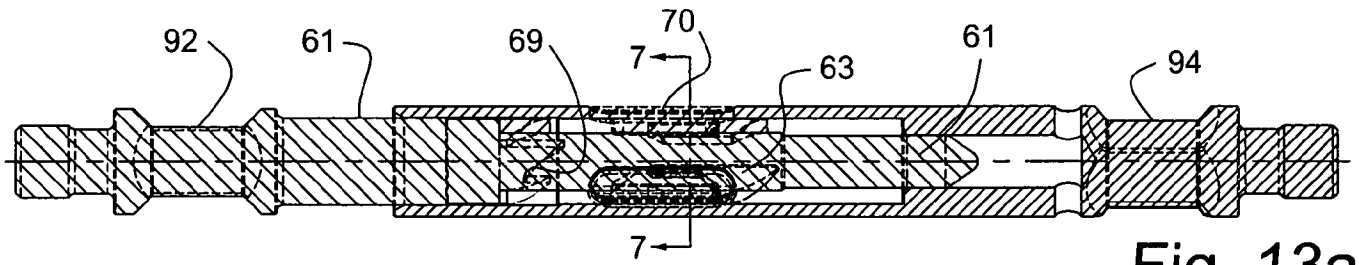
Fig. 13a
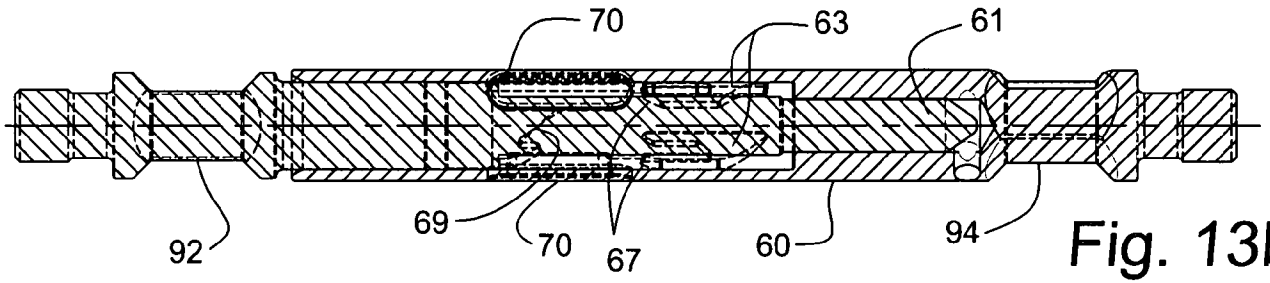
Fig. 13b
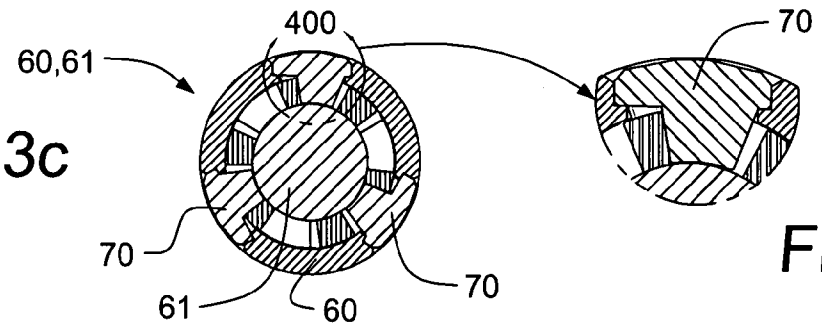
Fig. 13c
Fig. 13d
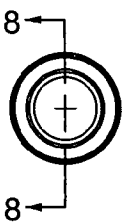
Fig. 13e

BEARING ASSEMBLY FOR A PROGRESSIVE CAVITY PUMP AND SYSTEM FOR LIQUID LOWER ZONE DISPOSAL

CROSS-REFERENCE TO RELATED APPLICATION

This application claims the benefits under 35 U.S.C. § 119(e) of the U.S. Provisional Application Ser. No. 60/406,338, filed Aug. 28, 2002, which is incorporated fully herein by reference.

FIELD OF THE INVENTION

In one aspect, the invention relates generally to the use of a progressive cavity pump (PC Pump) for pumping water downhole for disposal and more particularly to a bearing package for resisting reactive rotor loads of a PC Pump for pumping water downhole for disposal. In another aspect, the invention relates generally to complementary male/female profiled latch components which are applied in a variety of downhole operations to releasably couple components such as for coupling a pump rotor to a bearing package or drivably coupling a pump rotor to surface through a rod string.

BACKGROUND OF THE INVENTION

It has been a long recognized problem that during production of hydrocarbons, particularly from gas wells, liquids, primarily water, accumulate in the wellbore. As the liquid builds at the bottom of the well, a hydrostatic pressure head is built which can become so great as to overcome the natural pressure of the formation or reservoir below, eventually "killing" the well.

A fluid effluent, including liquid and gas, flows from the formation and through perforations in the casing. Liquid accumulates as a result of condensation falling out of the upwardly flowing stream of gas or from seepage of liquids from the formation itself. To further complicate the process, the formation pressure typically declines over time. Once the pressure has declined sufficiently so that production has been adversely affected, or stopped entirely, the well must either be abandoned or rehabilitated. Most often the choice becomes one of economics, wherein the well is only rehabilitated if the value of the unrecovered resource is greater than the costs to recover it.

Many techniques have been utilized to attempt to remove liquids which have accumulated in the wellbore. Of these many techniques some are focused on lifting liquids uphole to the surface, such as in gas or plunger lift systems. Other techniques have been focused on pumping water below the producing zone and into a lower portion of the formation that can act as a reservoir to accommodate the pumped water. These techniques are typified by arrangements that collect liquids below a conventional uphole-pumping pump, pump them slightly uphole and then route them back downhole through bypass tubing. These arrangements are subject to loss of head pumping failures in attempting to establish suction under low head conditions to pump uphole.

SUMMARY OF THE INVENTION

Described herein is a combination of novel elements which enable convenient and effective implementation of a system of direct pumping of liquid to a lower formation for disposal. In a preferred embodiment, a novel arrangement of a PC Pump is applied for pumping downhole through a packer, the rotor being rotatable yet axially restrained in a novel manner against uphole reactive loading and a novel latch being releasably coupled to the rotor.

In one aspect of the invention, a PC Pump is used to pump liquid directly downhole for disposal. However, Applicant's recognize that the rotor of the pump must be held down into position in the stator during this operation.

In one broad aspect of the invention, an apparatus is located in the casing of a wellbore for injecting liquid to a lower formation with a PC Pump having a rotor and a stator, comprising: a packer set in the casing above the formation and adapted for pumping liquids, from uphole of the packer, downhole through the PC Pump and into the lower formation; and a bearing assembly positioned downhole of the PC Pump and spaced from the stator, a shaft connected to the rotor and bearings for rotatably supporting and axially restraining the rotor to the bearing assembly so that as the PC Pump rotor rotated to pump liquid through the stator from above the packer to the formation below the packer, uphole loads acting on the rotor are restrained through the bearing assembly.

The apparatus enables operation of a method for injecting liquid from a wellbore into a lower formation comprising anchoring the packer in the wellbore above the lower formation; rotating the rotor for pumping liquids from uphole of the packer downhole through the PC Pump and into the lower formation; and supporting the rotor with a bearing assembly positioned downhole of the PC Pump and spaced from the stator.

Accordingly, in another aspect of the invention, a bearing assembly is provided for restraining uphole movement of a PC Pump rotor while pumping water downhole for disposal. The bearing assembly comprises a shaft extending through a bore in a housing and having bearings rotatably supporting the shaft from the housing, an uphole seal for sealing between the rotatable shaft and the housing; and a downhole seal for sealing the bore of the housing so as to protectively sandwich the bearings therebetween. Preferably, the uphole seal further comprises a first seal face sealed and rotatable with the shaft and biased to rotatably seal against a second seal face supported by and sealed to the housing. The bearing assembly is preferably pressure equalized having a piston in the bore of the housing and having annular seals therebetween; and a spring biasing the piston downhole so that the piston is sealably slidable in the bore for equalizing pressure between the formation and the bore.

Further, the rotor is preferably removable for maintenance. There are a variety of mechanisms to releasably couple downhole components including collets and shear devices. Due to the inaccessibility of the downhole location and the need for gross movements to effect actuating movement at the point of coupling, there is a need for a reliable and simple coupling device. As set forth above, one downhole operation which is critically dependent on the ability to releasably couple two downhole wellbore components is a situation wherein a PC Pump rotor is restrained against uphole movement as opposed to the conventional restraint against downhole movement during uphole pumping activities.

Accordingly, in yet another aspect of the invention, a releasable coupling or latch is provided. While the disclosed embodiments are predominately downhole implementations, the latch can be used as a surface as well, for instance, to drivably couple a top drive to a polish rod. Further, the latch has characteristics such as being preferably sufficiently compact to be insertable through the PC Pump's stator. In another downhole pumping situation, large PC Pumps can be suspended at the end of tubing. However, the corresponding and large rotors are too large to insert or remove through the tubing string. Accordingly, in this situation, there is a need for a torque-capable releasable coupling between the drive rod string and the uphole end of a rotor which remains in the stator of the PC Pump.

A qualifying releasable coupling for each of these scenarios is a telescopically coupled plunger and latch housing having complementation radial dogs and a track which implement downhole and uphole manipulation therebetween to effect an automatic, indexed relative rotation therebetween to alternately lock and release the coupling while further enabling the transmission of torque as desired. The tool is implemented in an alternating on/locked and off/released manner.

In one broad aspect of the invention apparatus for releasably coupling first and wellbore components, at least one of the first or second wellbore components being capable of rotation in response to applied rotational force, comprises a housing adapted for connection to the first wellbore component and having a bore with a first half of a dog and track arrangement formed thereto having at least one dog; and a plunger adapted for connection to the second wellbore component and being sized to fit telescopically axially into and out of the bore, the plunger having a second half of the dog and track arrangement formed thereto, the track of the dog and track arrangement having at least one entrance to and from a circumferential portion, the circumferential portion bounded by a discontinuous proximal cam, through which the at least one entrance extends, and a distal cam spaced from the proximal cam, so that in a first action, when the plunger telescopes into the housing, each dog is guided through the at least one entrance into the circumferential portion, coupling the plunger and the housing, each dog contacting the distal cam for causing relative rotation between the housing and the plunger until engaging a first rotational stop out of alignment with the entrance in a first rotationally and axially coupled position, and in a second action, when the plunger telescopes out of the housing, each dog contacts the proximal cam for causing relative rotation between the housing and the plunger until engaging a second rotational stop out of alignment with the entrance in a second rotationally and axially coupled position, and in a third action, when the plunger telescopes into the housing, each dog contacts the distal cam for causing relative rotation between the housing and the plunger until engaging a third rotational stop substantially aligned with the entrance, so that in a fourth action, when the plunger telescopes out of the housing, each dog is guided through the at least one entrance to release the plunger from the housing.

In another broad aspect, the apparatus enables practicing a novel method for releasably coupling a first wellbore component to a second wellbore component, comprising: telescoping the plunger into the housing for guiding the one or more dogs through corresponding entrances into the track and engaging the track to causing relative rotation between the housing and the plunger until engaging a first rotational stop in a first rotationally and axially coupled position out of alignment with the corresponding entrances, and telescoping the plunger out of the housing for engaging the track and causing relative rotation between the housing and the plunger until engaging a second rotational stop in a second rotationally and axially coupled position out of alignment with the corresponding entrances, and telescoping into the housing for engaging each dog with the track to causing relative rotation between the housing and the plunger until engaging a third rotational stop substantially aligned with the corresponding entrances, and telescoping the plunger out of the housing for guiding each dog through the corresponding entrances to release the plunger from the housing.

Preferably, the releasable coupling is located between the downhole end of a rotor of a PC Pump and an uphole end of a bearing assembly spaced below the PC Pump.

BRIEF DESCRIPTION OF THE DRAWINGS

FIGS. 9*a–c* are partial side views illustrating the housing and plunger of another embodiment of the invention, operating according to the principles set forth in FIG. 8 and illustrating the sequence for engaging the latch plunger of a rotor to the latch housing of the bearing assembly where, FIG. 9*a* illustrates the latch plunger entering a bore of the latch housing, FIG. 9*b* illustrates the latch plunger being pushed into the latch housing, rotating the latch housing to cause a latch dog to engage the upper latch track, and FIG. 9*c* illustrates pulling the plunger uphole to cause the latch housing to rotate and the latch dog to lock into the lower profiled track;

FIGS. 13*a*–13*b* illustrate cross-sectional views of the male and female components of the latch in the working and fully set downhole rotated position taken along section lines 8–8 of FIG. 13*e;*

FIG. 13*c* is a cross-sectional view of the latch housing and plunger taken along sectional lines 7—7 of FIG. 13*a;*

FIG. 13*d* is a cros-sectional view according to the cutaway 400 of FIG. 13*c*; and FIG. 13*e* is a cross-sectional view of a latch housing and plunger in accordance with the present invention.

DETAILED DESCRIPTION OF THE PREFERRED EMBODIMENT

Figure 1:
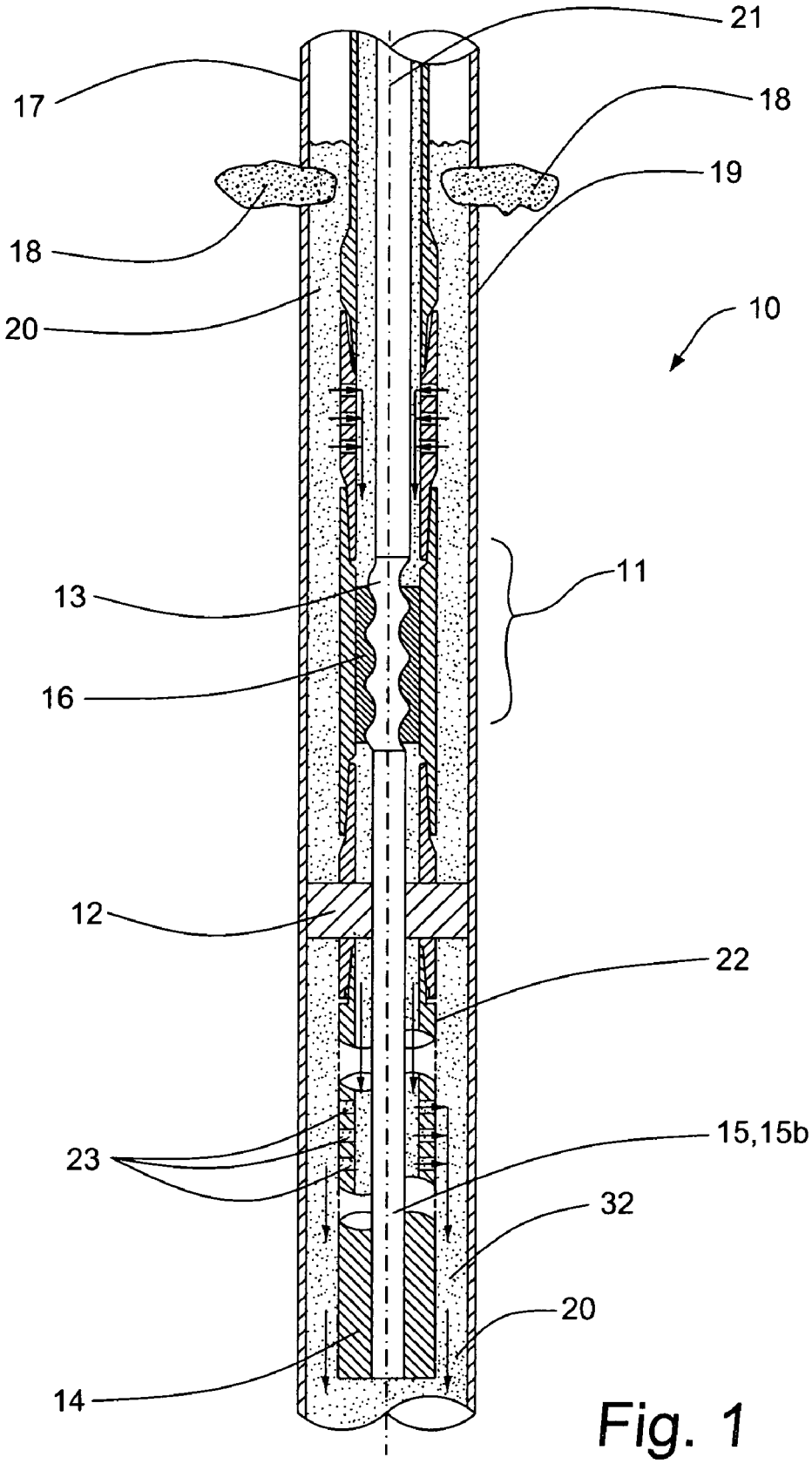
FIG. 1 is a cross-sectional elevation of a wellbore having PC Pump and a bearing assembly accordingly to one embodiment of the invention.

With reference to the schematic of FIG. 1, a system 10 is provided for lower zone disposal in a well. A PC Pump 11 is located downhole and arranged to pump below a packer 12 to isolate a zone below the pump itself. Conventional rod string is threaded for RH rotation. Causing a PC Pump to pump downwardly without first pumping uphole can be achieved with a downwardly pumping rotor having and opposite helix to conventional rotors so that conventional rod threading and rotation can be maintained. The PC Pump rotor 13 is restrained from reactive uphole movement with a bearing assembly 14 and coupling means 15 are provided for releasably coupling the rotor 13 with the bearing assembly 14.

Each of the bearing assembly 14, the disposal system 10 and the coupling means 15 are discussed herein.

Generally, with reference to schematic FIG. 1, and to more detailed FIGS. 10*a*–11*b*, several embodiments of the invention are illustrated for disposing of liquid to a formation below a packer 12. In one embodiment in FIGS. 1 and 10*a*–10*b* a stator 16 of the PC Pump 11 is fit to the bottom of a tubing string 17 and positioned downhole below perforations 18 in the casing 19 of a cased wellbore of a gas well. As shown, accumulated liquid 20 can interfere with the perforations and inflow of gas. Tubing perforations 20*b* positioned downhole of the casing perforations 18 enable draining of accumulated liquid into the PC Pump 11. Minimum pumping head issues are obviated by placing the PC Pump suction at the top of the pump for downward pumping. The PC Pump rotor 13 is suspended from a rod string 21 extending downhole in the tubing string 17 to fit operable into the stator 16. The rotor 13 extends through a pup-joint 22 to connect to a bearing assembly. Liquid from the PC Pump is discharged through perforations 23 in the pup joint 22 for disposal into a lower formation 30 (FIG. 10*b*), typically through a one-way valve 31.

The bearing assembly 14 is spaced and supported from the stator 16 via the pup-joint connection 22 for resisting the loads placed thereon by the rotor. The stator 16 is typically supported in the casing 19 with the packer 12. Use of a convention anchor is optional in conjunction with the packer 12 or if the packer 12 is not rotationally supporting the stator 16.

Similarly in the embodiment of FIGS. 11*a*, 11*b*, a PC Pump is positioned downhole below the perforations 18 in the casing and the casing 19 itself is used as the gas production tubing to surface. The PC Pump stator or other connected tubing is isolated with the packer 12 and is anchored to the casing 19 without the need for a supporting tubing string.

The packer 12, preferably a hydraulic packer, is set adjacent a bottom of the well above the lower formation 30 into which water can be disposed. The operation of the system is described in greater detail below.

As shown in FIG. 1, in use, the downhole-pumping rotor 13 generates uphole reactive loads. If not restrained, the rotor 13 will move uphole to pull free or otherwise damage the stator 16. Accordingly, the rotating rotor 13 is restrained against uphole movement with the bearing assembly 14. The reactive loads borne by the bearing assembly 14 are resisted through the pup-joint connection 22 to the bottom of the PC Pump stator 16.

Water Disposal

Figure 10A:
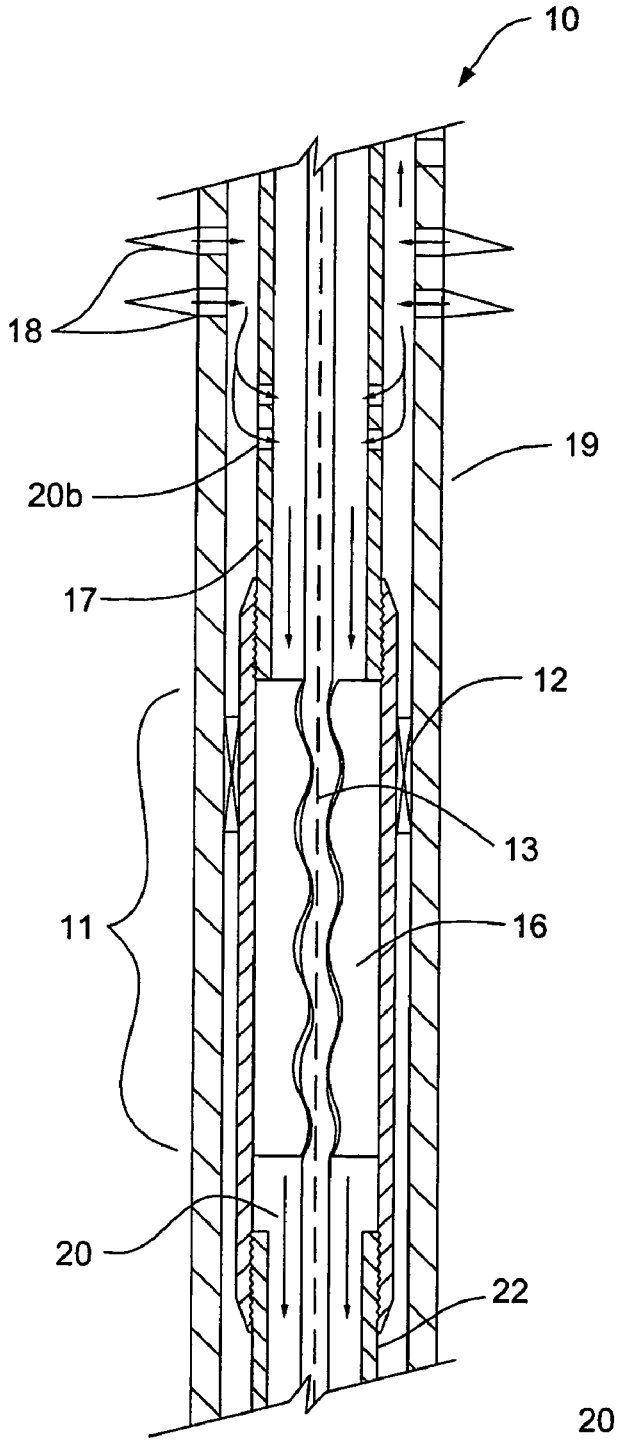
FIGS. 10*a* and 10*b* together illustrate a cross-sectional view of a wellbore casing according to an embodiment of the invention wherein a stator of a PC Pump is connected to a tubing string and wherein the rotor is installed through the tubing string and into the stator, the lower end of the rotor being latched into a lower bearing assembly for pumping liquid water downhole, the packer, an optional anchor and a one way valve being illustrated in schematic form only.
Figure 10B:
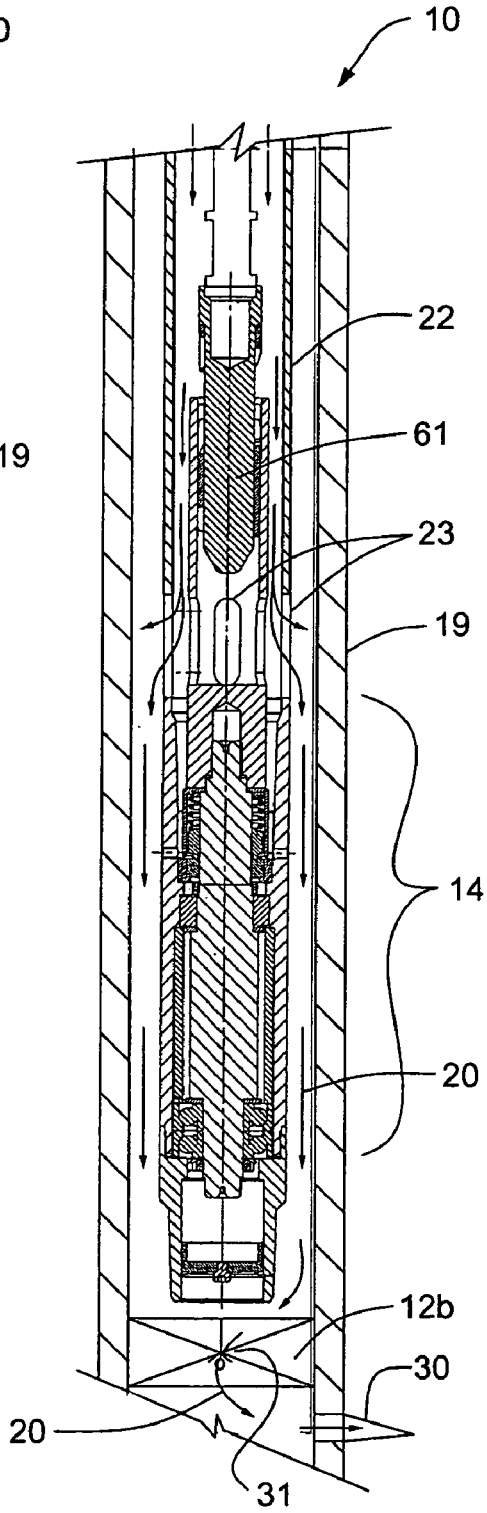

For implementing an embodiment of the disposal invention, as shown in FIGS. 10*a*–10*b*, a bottom packer 12*b*, preferably a hydraulic packer, is set adjacent a bottom of a well above a lower formation 30 into which liquid such as water can be disposed. A tubing string 17 containing the bearing assembly 14 and latch housing 60 of the present invention as well as the stator 16 of a PC Pump 11 is lowered into the wellbore above the bottom packer 12*b*. A second packer 12 is set near the top of the PC Pump 11 to hold the stator 16 and tubing 17 in place. The intake of the PC Pump 11 is positioned below the perforations. A plunger 61 is attached to a rotor 13, preferably by a pony rod 21 so as to minimize any effects caused by the eccentric rotation of the rotor 13. A series of ports 20*b* are formed in the tubing string 17 below the perforations 18 and above the PC Pump 11 to permit water, which is heavier than gas to enter and fall into the pump. The PC Pump is configured to draw the water downhole and through a one way valve 31 such as that set in bottom packer 12*b*. Thus the liquid, disposed of in the higher pressure formation below, cannot return uphole.

The rotor 12 is lowered into and through the stator 16 until the plunger 61 engages the latch housing 60 and the rotor 12 is locked into position in the bearing assembly 14. Pumping can then begin.

Figure 11A:
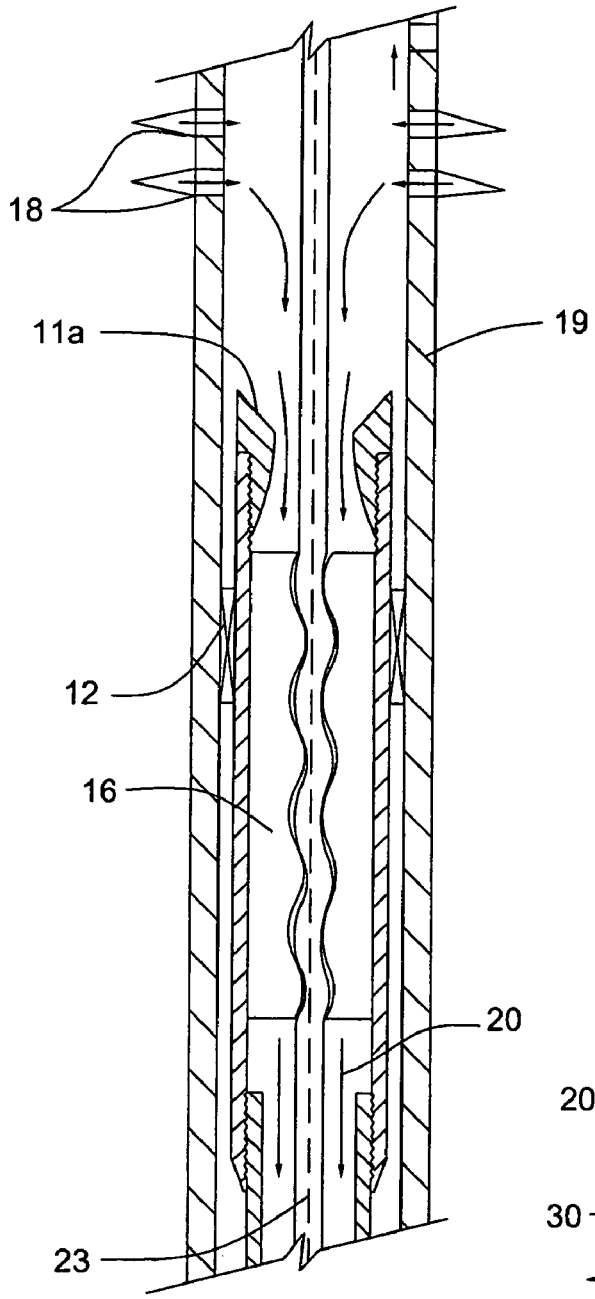
FIGS. 11*a* and 11*b* together illustrate a cross-sectional view of a wellbore casing according to another embodiment of the invention wherein the rotor of a PC Pump, anchored downhole, is lowered into the stator using co-rod, coiled tubing or the like, and is latched into a lower bearing assembly for pumping liquid water downhole.
Figure 11B:
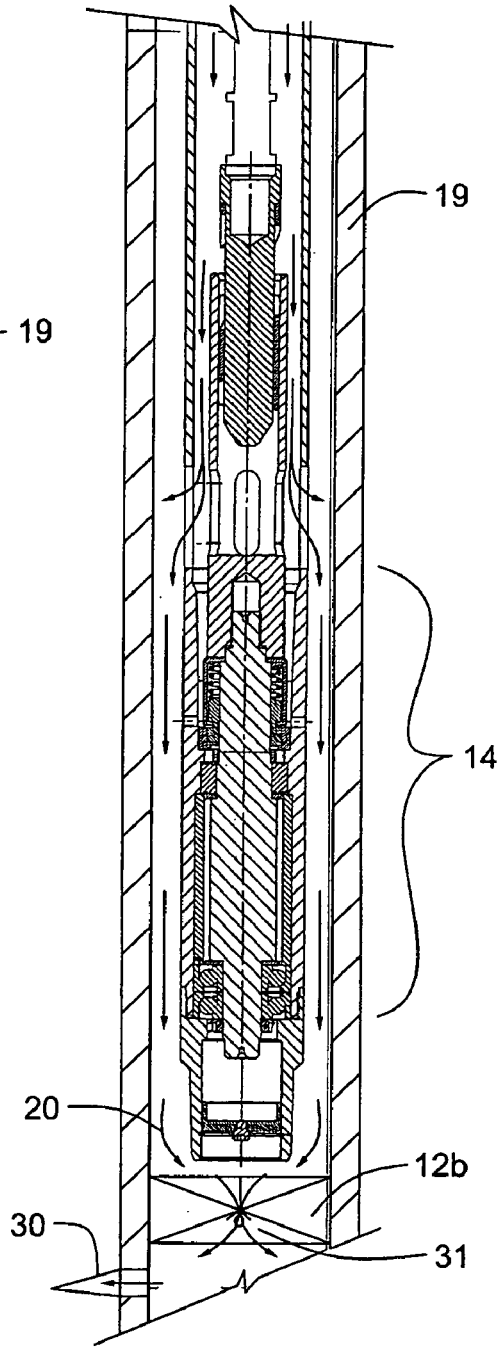

In a second embodiment of the invention, as shown in FIGS. 11*a*–11*b*, a lower packer 12*b* is set as in the first embodiment. The bearing assembly 14 with a stator 16 attached at surface is lowered into the wellbore, below the perforations 18 using coiled tubing or the like (not shown) and is held in place by a second packer 12 set adjacent an uphole end of the PC Pump 11. A cone inlet 11 a is fit to the inlet of the stator 11 to assist in directing the plunger 61 and rotor 12 into the stator. The rotor 13 and attached plunger 61 are then lowered into the wellbore using co-rod or coiled tubing and the rotor 13 is latched to the bearing assembly 14 as described above. Liquid produced through the perforations 18 above the pump falls into the cone inlet 11*a* and enters the PC Pump 11. In the embodiment of the invention shown in FIGS. 11*a*, 11*b*, significant costs can be saved as a service rig is not required, due to the elimination of jointed tubing string. All of the operations described in this embodiment can be performed using co-rod or coiled tubing without the need for a service rig.

Bearing Assembly

With reference to FIGS. 2, 3*a*–*c*, and 10*b* the bearing assembly 14 is provided for preventing uphole movement of the rotor 13 of a PC Pump 11 while pumping liquid 20 downhole for disposal.

As shown in FIGS. 1, 10*b*, the bearing assembly 14 does not impede the casing 19 so that disposed liquid 20 can pass thereby. A bypass of the bearing assembly can be through the assembly itself (not shown) or, as shown, can be around the assembly through an annular passage 32 formed between the assembly 14 and the casing 19.

Figure 2:
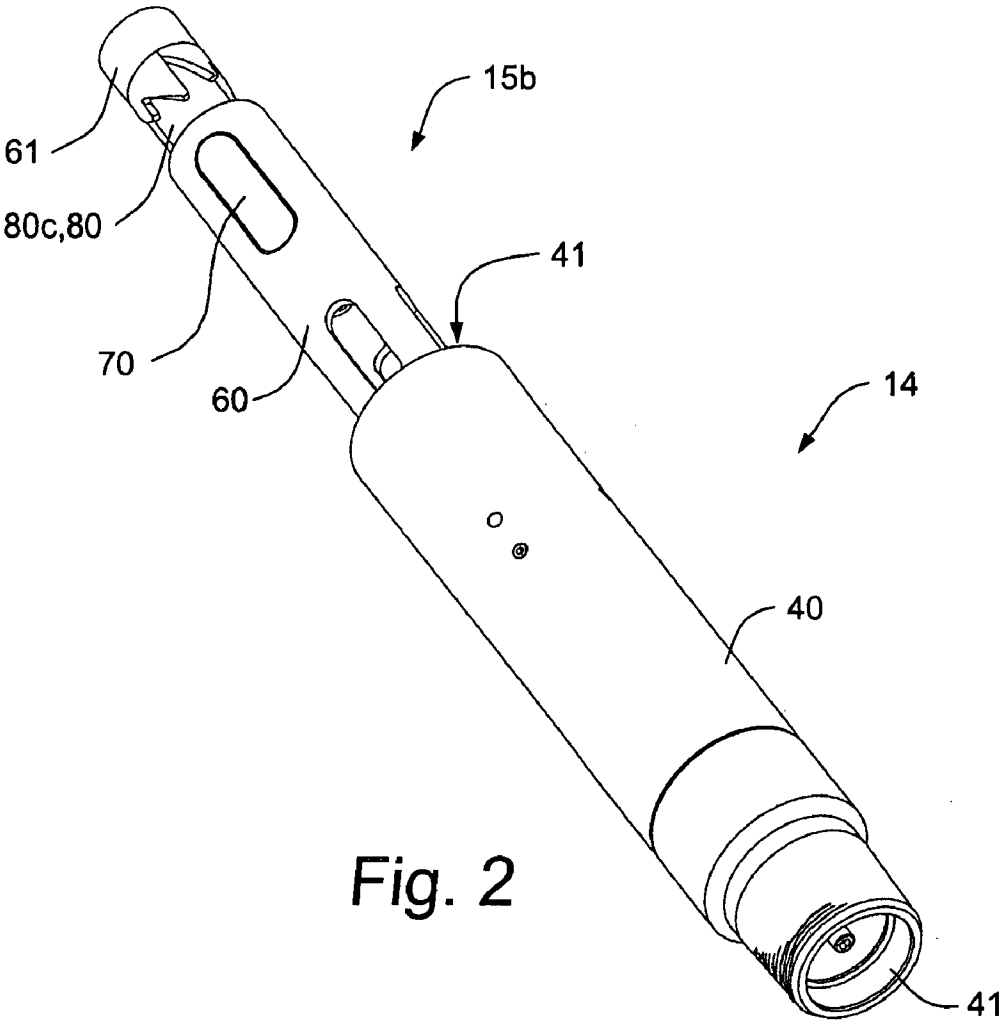
FIG. 2 is a perspective view of the housing of a bearing assembly of the present invention having a latch housing connected thereto for connection using a latch plunger to a rotor (not shown) of a PC Pump.
Figures 3A, 3B, 3C:
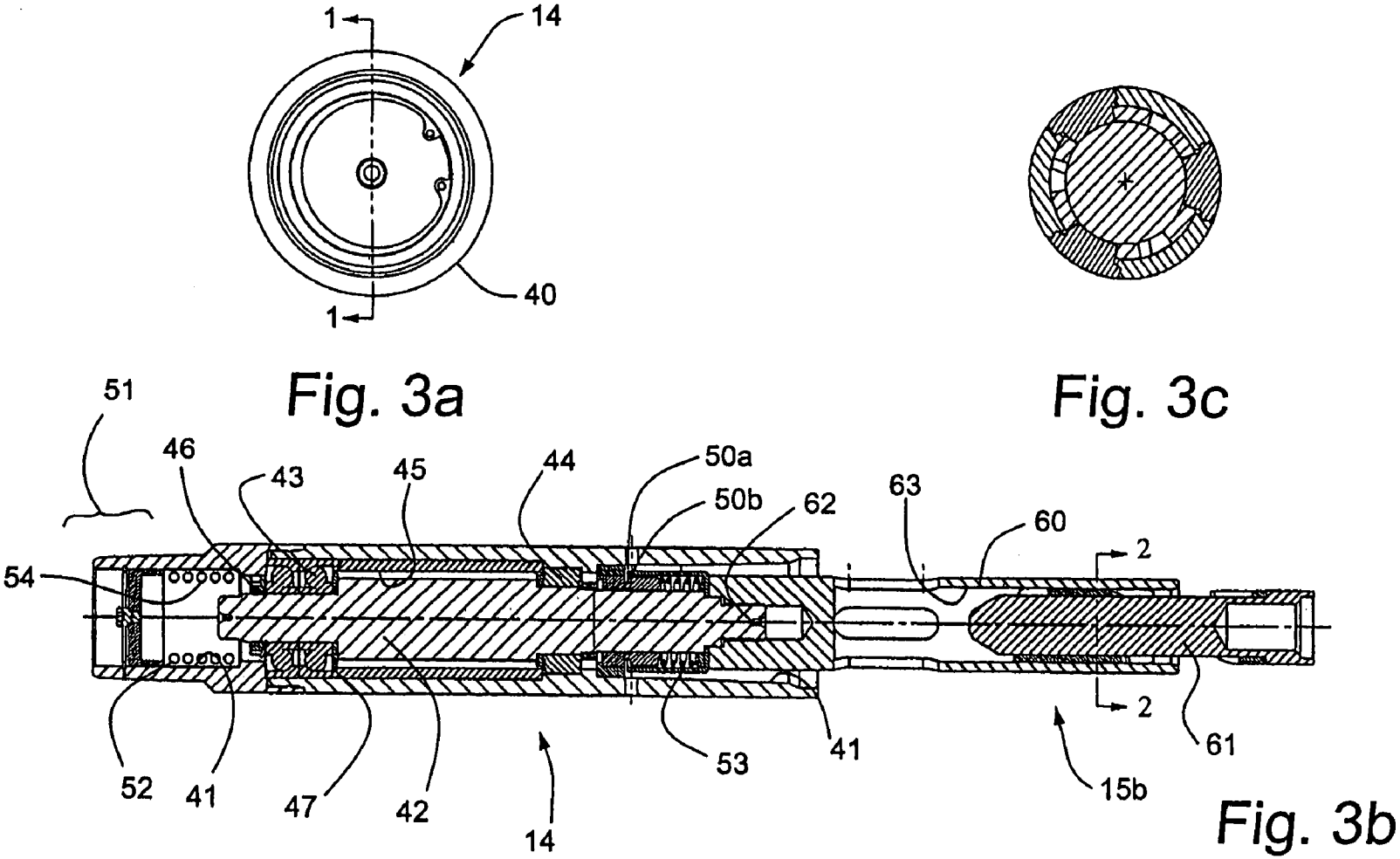
FIG. 3*a* is a downhole end view of the bearing assembly housing according to FIG. 2 further detailing showing a snap ring at a lower end of the housing, a hex nut and a lower piston face retained by the snap ring.
FIG. 3*b* is a cross-sectional view of the bearing assembly housing, latch housing and plunger according to FIG. 3*a* as sectioned along section lines 1—1.
FIG. 3*c* is a cross-sectional view of the latch housing and plunger according to FIG. 3*b* taken along section lines 2—2.

As shown in FIGS. 2 and 3*b*, the bearing assembly 14 comprises a non-rotating bearing housing 40 defining a bore 41 through which a rotating inner shaft 42 extends. An annular passage 32 is formed between the housing 40 and the casing 19 (see FIG. 10*b*). The housing 40 is secured against rotation and relative movement relative to the PC Pump (not shown).

A latch housing 60 is connected at an uphole end of the inner shaft 42 and is adapted for latching to a plunger 61 adapted for connection to the rotor 13 of the PC Pump 11. The inner shaft 42 is supported for rotation and against reactive axial loading. One or more lower thrust bearings 43 are positioned adjacent a lower end of the shaft 42. One or more upper radial bearings 44 are fit adjacent an upper end of the inner shaft 42. While preferably the upper bearings 44 support radial loading, they may also support axial thrust. Similarly, while it is preferred that the lower bearings 43 primarily support thrust, they may also be specified to support radial loading as well. The lower and upper bearings 43,44 are isolated from well liquids 20 with a sealing system.

The lower thrust bearings 43, such as angular contact ball bearings, are fit to an annular space 45 created between the inner shaft 42 and the non-rotating outer housing 40. A nut and washer assembly 46 secure the lower end of the inner shaft 42 to the lower thrust bearings 43 which are rotationally supported through a shoulder 47 formed in the outer housing 40. The annular space 45 is sealed from the wellbore environment by upper seals 50*a*,50*b* and a lower seal 51. The lower seal 51 is formed between a spring-biased lower piston 52 between the lower bearings 43 and the outer housing 40. The lower seal 51 is a non-rotating seal sealably and slidably fit to the non-rotating outer housing 40. The lower piston 52 is spaced downhole of the lower end of the inner shaft 42 creating a reservoir for clean lubricating fluid in fluid communication with the annular space 45 for lubricating the bearings 43,44.

The inner shaft 42 is further supported against lateral and radial loading by the upper radial bearings 44 such needle bearings positioned in the annular space 45 adjacent an upper seal housing 53 positioned between the upper seal 50 and the outer housing 40. The upper seal housing 53 is located above the upper bearings 44. The upper seals 50*a*, 50*b* seal despite relative rotation between the inner shaft 42 and the housing 40.

The upper seals 50*a*,50*b* preferably comprise opposing, mirrored tungsten or silica carbide seal faces. A first rotating upper seal 50*b* is connected to the inner shaft 42 by the upper seal housing 53 and a second static upper seal 50*a* is connected to the outer housing 40 below the first rotating upper seal 50*b*. The first rotating upper seal 50*b* is biased towards and rotates upon the second static seal face 50*a* in a sealed relationship so as to substantially prevent the loss of lubricant from the annular space 45.

The lower seal's lower piston 52 acts to equalize pressure within the annular space 45 to be substantially that in the wellbore. Further, the lower piston 52 has a preload spring 54 which allows it to react to small losses of lubricant from the bearing assembly annular space.

As shown in FIGS. 10*a*, 10*b* and 3*b*, the rotor 13 and plunger 61 releasably couple to the latch housing 60 for restraining the rotor 13 thereto and thereby retaining the rotor 13 in the PC Pump stator 16 in a proper pumping relationship.

Latch

In greater detail and with reference to FIGS. 3*b*, 4–7*d*, the means 15 for connecting the rotor and bearing assembly 14 is a latch 15*b*. The latch is capable of releasably coupling a variety of wellbore components together without the need to specifically rotatably align the cooperating mating components themselves. Further, once latched, the latch 15*b* can transmit significant torque as well as maintain axial coupling. In one embodiment, the latch 15*b* is employed to releasably couple or lock the rotor 13 of the PC Pump 11 to the bearing assembly 14.

As shown in FIG. 3*b*, the latch 15*b* comprises a latch housing 60 adapted for connection to a first wellbore component such as the bearing assembly 14. As shown in this embodiment, the latch housing 60 is connected at a top end 62 of the bearing assembly's shaft 42 through a threaded or other connection for co-rotation therewith. The latch housing 60 has a bore 63. The plunger 61 is similarly adapted for connection to the second wellbore component such as a threaded or other connection to the lower end of a PC Pump rotor 13. The plunger 61 is sized to couple telescopically and axially with the housing's bore 63. One of either the housing or plunger is capable of at least limited rotation to permit some relative rotation between the plunger and the housing. In this embodiment, the coupling and releasing action of the plunger and the housing impose rotational forces, causing the passive component to rotate. In the PC Pump embodiment, one of the rotor 13 or the bearing assembly 14 is capable of rotation, typically the housing freely rotates with the bearing assembly in reaction to a rotational force imposed by the plunger.

As shown in FIGS. 10*a*–11*b*, the plunger 61, having a diameter less than an overall diameter of the latch housing 60, is advantageously connected to the rotor 13 for facilitating passage through the stator 16 with minimal interference. Where such diametral restriction is not a factor the relative positions of the plunger 61 and the latch housing 60 may be reversed. For ease of discussion herein, unless otherwise specified, the context is described with respect to the plunger being the uphole wellbore component.

Figure 4:
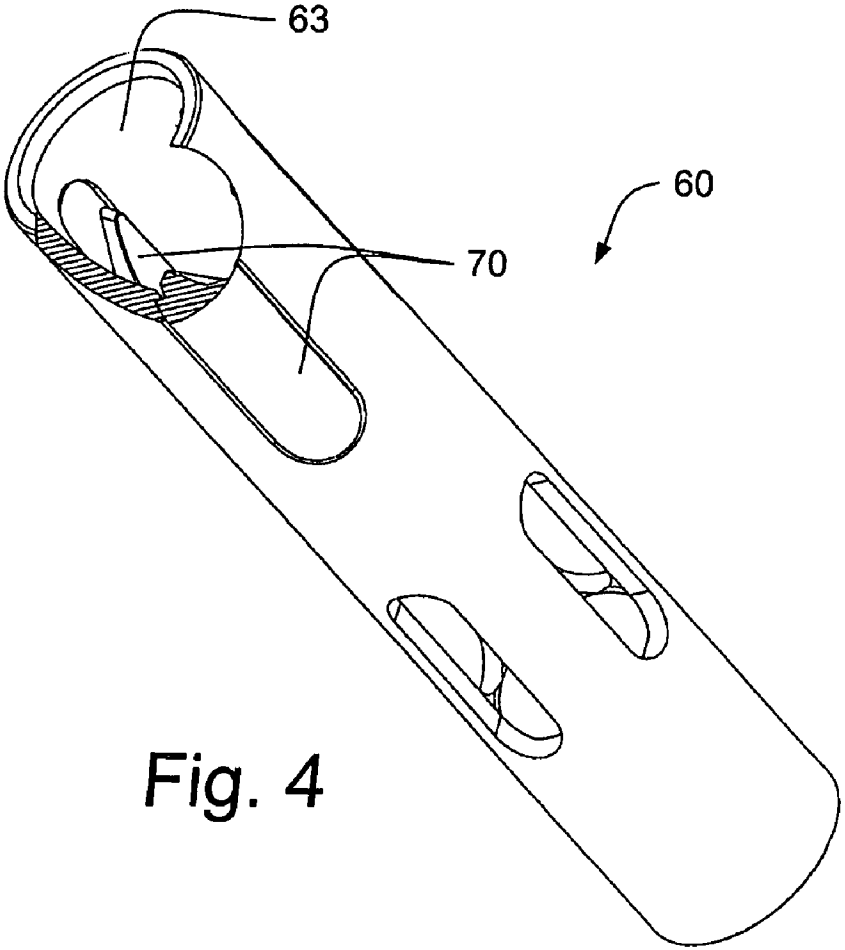
FIG. 4 is a perspective view of the latch housing according to FIG. 3*b* with a partial cutaway to illustrate the radial profile of a latch dog.

With reference to FIGS. 4 and 5, the latch 15*b* operates using guided movement of one or more dogs 70, which extend radially from one of either the latch housing 60 or the plunger 61, in a track 80 which is formed in the complementary and opposing plunger or latch housing 60 respectively.

Figure 5A:
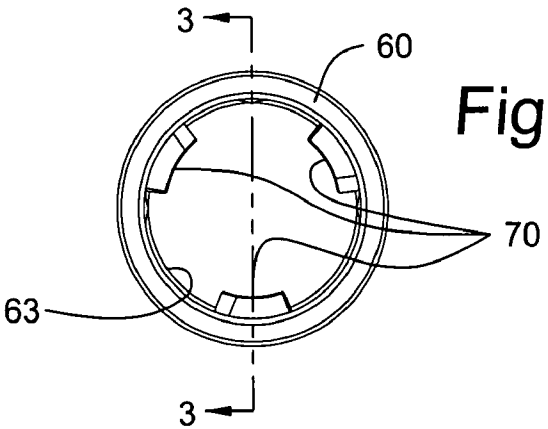
FIG. 5*a* is an end view of a latch housing according to FIG. 4.
Figure 5B:
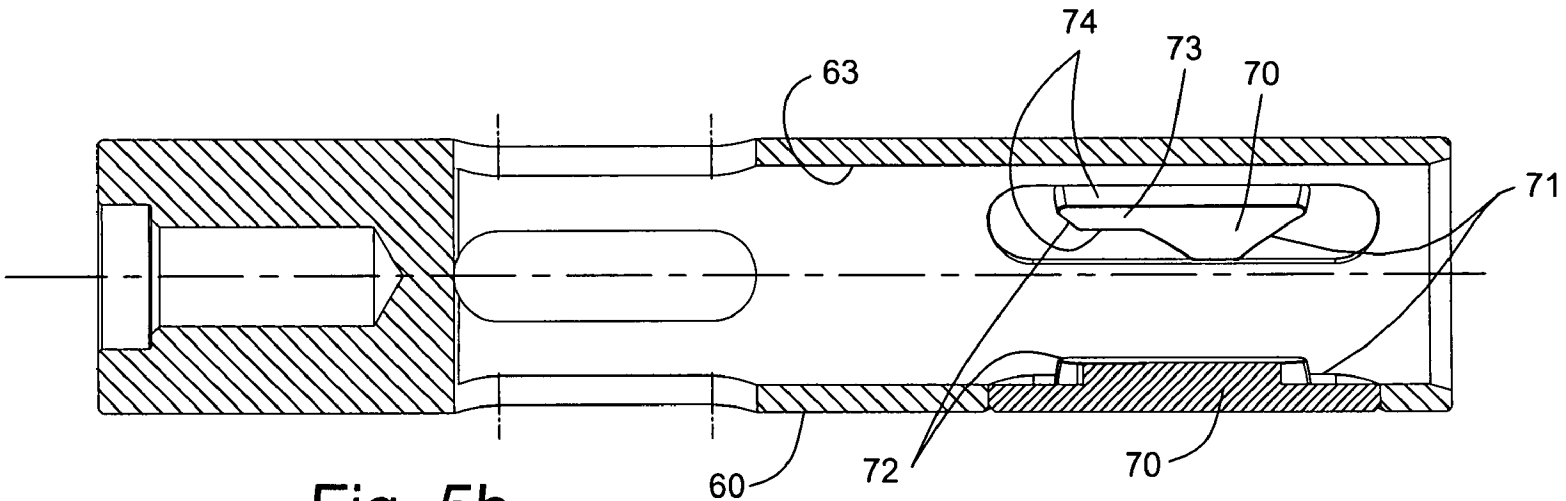
FIG. 5*b* is a cross-sectional view of the latch housing according to FIG. 5*a* taken along section lines 3—3 and illustrating an axial post at a downhole end for coupling to a shaft of the bearing assembly.
Figure 8:
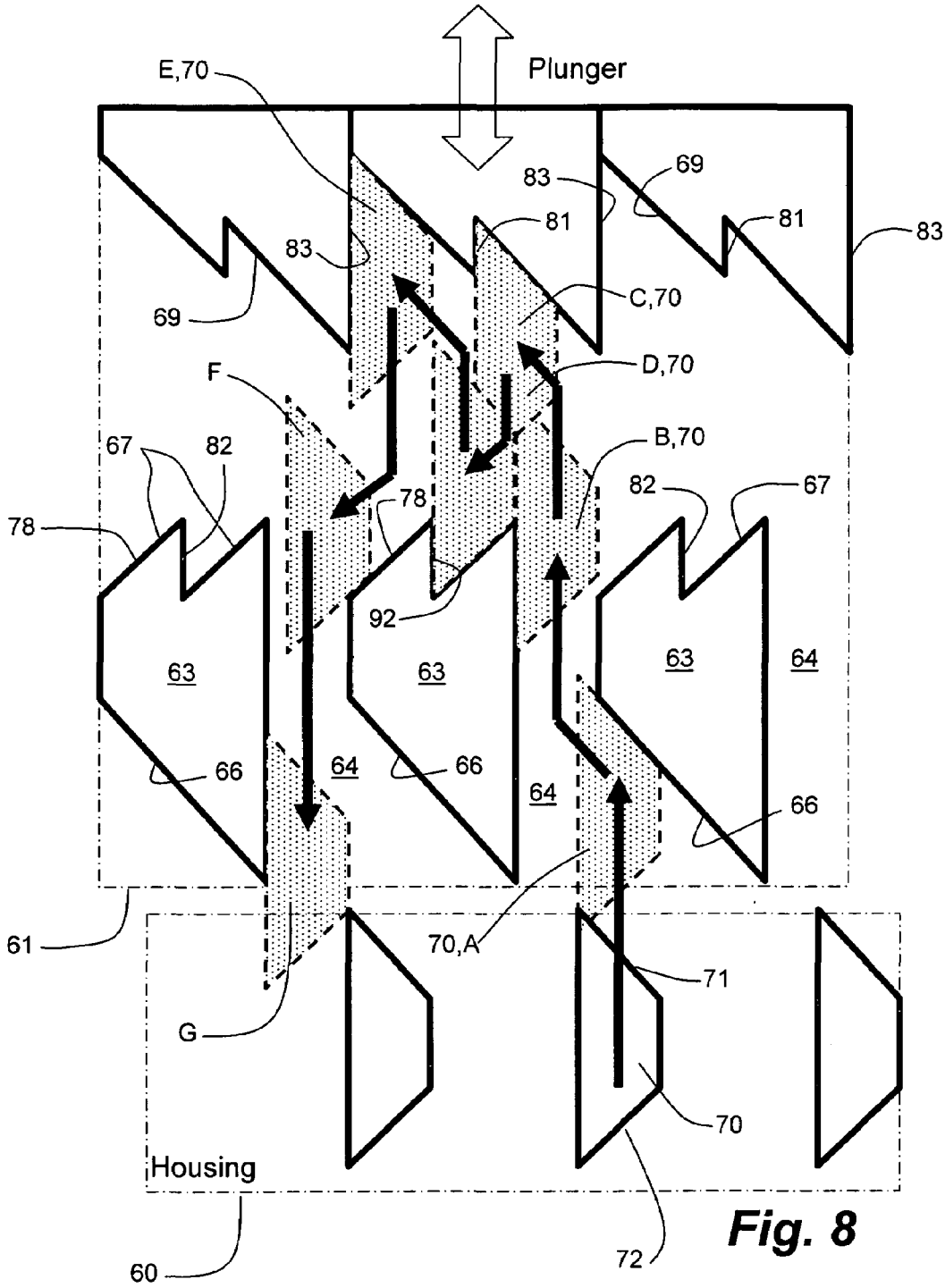
FIG. 8 is a roll-out schematic view of the circumferential arrangement of a latch according to one embodiment of the invention. The roll-out illustrates the progressive movement of a dog of the latch housing (only one of three shown for clarity) as the plunger and the lower and upper profiled tracks interact with the latch dog between released, latched, and released once again.

In the illustrated embodiment of FIGS. 3*c*, 4 and 5*a*, one or more dogs 70 (three equidistant circumferentially-spaced dogs 70 shown) extend radially into the bore 63 of the housing with a complementary radially extending track 80 being formed in the plunger 61. In FIGS. 8 and 5*b*, each dog has a substantially trapezoidal shape having an uphole leading edge 71 and a downhole trailing edge 72. The leading edge 71 is angled and the trailing edge 72 is also angled. In FIG. 5*b*, the trailing edge 72 is optionally formed as an extended key 73 with substantially parallel side edges 74 while retaining the angled trailing edge 72.

With reference to FIGS. 6*a*–*e*, the plunger 61 comprises a tapered lower end 62. Best shown on FIGS. 6*c*–6*e*, formed on an outer surface of the plunger 61 is a plurality of radially outwardly raised segments 63 spaced sufficiently circumferentially from one another so as to form one or more entrances 64 corresponding to each of the one or more dogs. Each entrance 64 to the track permits a corresponding dog 70 to pass axially thereby to the track 80. Three dogs 70, requiring corresponding three entrances, automatically distributes loads such as torsional loads.

The track 80 is adapted to sequentially accept the one or more dogs 70 through the entrances 64; guide and lock the dogs therein and then release the dogs. Each entrance 64 leads to a track's circumferential portion 80*c* bounded with a uphole cam 67, proximal the entrances 64, and a downhole cam 69 spaced from the entrances 64 and from the uphole cam profile 67. The uphole cam is discontinuous, interrupted circumferentially by entrances 64.

The uphole and downhole orientations are for reference only, pertinent for this embodiment, and could be inverted in other embodiments.

Angled downhole faces 66 of the segments 63 guide the dogs 70 into their respective entrances 64. Uphole faces of the segments form a discontinuous downhole cam 67, interrupted by the entrances 64. Spaced uphole from the downhole cam 67 is a shoulder 68 forming an uphole cam 69. The uphole and downhole cams 69,67 are spaced sufficiently apart to permit circumferential and stepwise movement of the dogs 70 therebetween.

The downhole cam 67 guides each dog's trailing edge 72 and the uphole cam guides each dogs' leading edge 71 through the track's circumferential portion 80*c*. The track 80 enables alternating the plunger 61 between a coupled position and a released position. The uphole and downhole cams are formed with angled faces complementary to each dog's leading and trailing edges respectively.

The plunger and latch housing are in a coupled position occurs in at least one instance when the plunger 61 is being pulled axially way from the latch housing 60 wherein each dog's trailing edge 72 engages the downhole cam 67 (tensile forces acting between the plunger 61 and the latch housing 60). The plunger and latch housing can be locked in a second instance when the plunger 61 is engaged fully into the latch housing 60 and each dog's leading edge 71 engages the uphole cam 69 (compressive forces acting between the plunger 61 and the latch housing 60).

More specifically, and with reference to the rolled-out view of the plunger 61 and latch housing in FIG. 8 and the exploded views of FIGS. 9*a*–9*c*, the sequence of operation on one typical dog 70 is illustrated as follows. The plunger 61 and attached rotor (not shown) are lowered through the wellbore and stator until the plunger encounters the latch housing 60.

As shown at A, in a first action, the plunger 61 is stabbed into the housing (FIGS. 8,9*a*). Downhole force applied to the plunger 61 results in engagement of each dog's leading edge 71 with each segment's angled downhole face 66 causing relative rotation of the latch housing 60 and plunger 61, typically causing the latch housing 60 to rotate sufficiently to permit the dogs 70 to align with and pass axially through each entrance 64, at B, and into the circumferential portion 80*c* between the uphole and downhole cams 69,67.

With reference to FIGS. 8, 9*b*, each dog 70 engages the uphole cam 69 for enabling indexed relative rotation from B to C, and misaligning each dog 70 from an entrance 64 so that the dogs cannot be directly released from the circumferential track portion 80*c*. Relative rotation stops when the dog 70 engages a first rotational stop 81 formed in the uphole cam 69. At C, the leading edge 71 of each dog 70 is positioned and restrained in a first coupled position for locking the plunger 61 into compressive coupling with the latch housing. Torque applied by the plunger 61 is capable of driving the latch housing 60. Typically, a rod string 21 is threadably connected and is capable of drivable RH rotation without unthreading. Accordingly, in most instances, the rotational stops and angled faces of the uphole and downhole cams are arranged so as to provide driving surfaces . The orientation of angles is dependent on which of the plunger and housing are driving and which is being driven.

With reference to FIGS. 8, 9*c*, upon a second and subsequent uphole action from C to D of the rotor 13 and plunger 61, such as during downhole pumping, the plunger 61 moves uphole relative to the dogs 70 to D, wherein the trailing edges 72 of the dogs 70 engage the downhole cam 67, guiding each dog 70 through indexed relative rotation to a second rotational stop 82 so as to position and restrain each dog's trailing edge 72 in a second coupled position for locking the plunger 61 in axially tensile coupling with the latch housing 60. In the embodiment of the PC Pump 11 and rotor 13, this is the operational mode wherein the rotor 13 imposes tensile loads for co-rotation with the latch housing 60, such loads being further borne or restrained by the bearing assembly 14. In this mode, the plunger 61, while under tensile loading can also rotatably drive the latch housing 60.

Figure 6B:
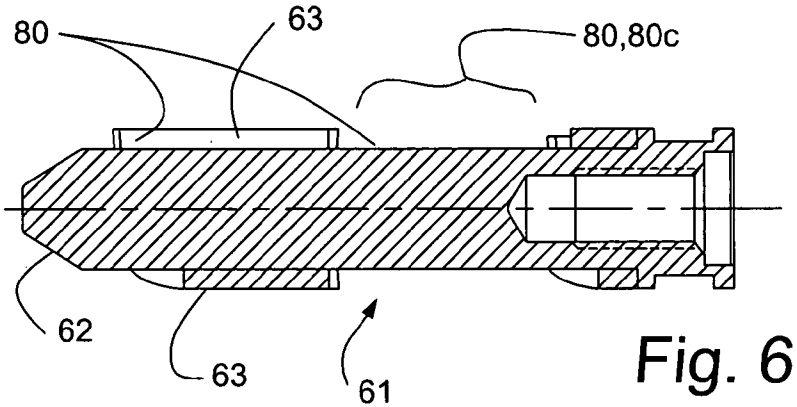
FIG. 6*b* is a cross-sectional view according to FIG. 6*a* taken along section lines 4—4.
Figure 6E:
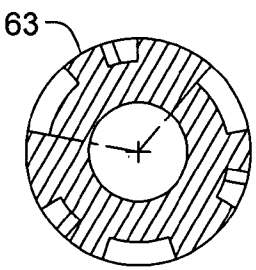
FIG. 6*e*is a cross-sectional view according to FIG. 6*c* along section lines 6—6.
Figure 6D:
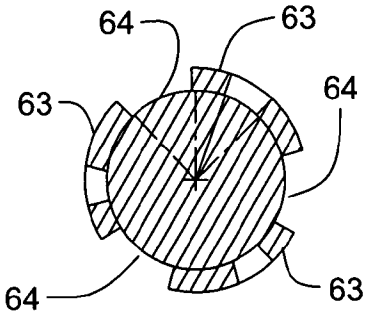
FIG. 6*d* is a cross-sectional view according to FIG. 6*c* along section lines 5—5.
Figure 6A:
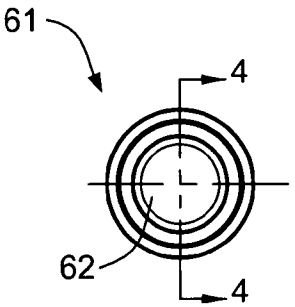
FIG. 6*a* is a downhole end view of a latch plunger adapted for connection to the rotor of a PC Pump, the plunger being adapted for latching with the latch housing and latch dogs according to FIGS. 3*b* and 5*b;*
Figure 6C:
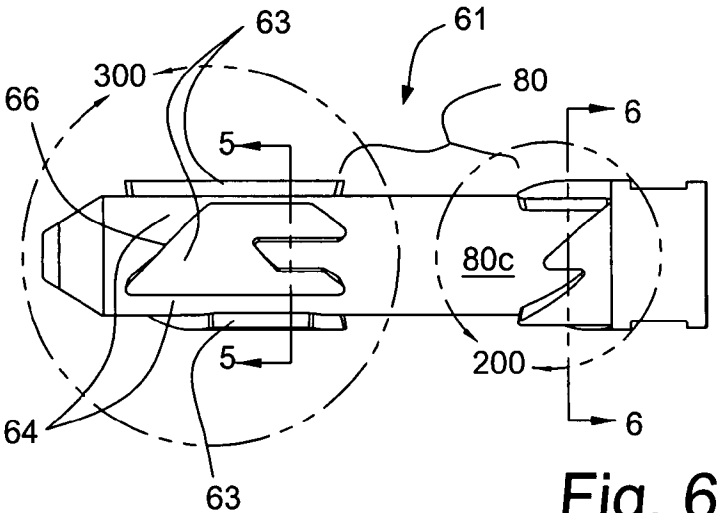
FIG. 6*c* is a side view of the latch plunger according to FIG. 6*b;*
Figure 7A:
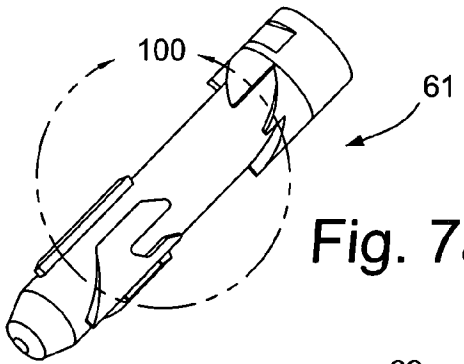
FIG. 7*a* is a perspective view of the latch plunger according to FIG. 6*c;*
Figure 7B:
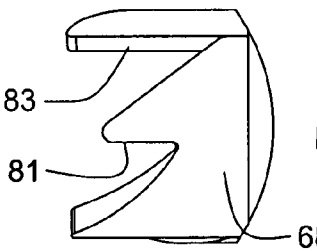
FIG. 7*b* is a partial perspective view of an upper profiled track and a lower profiled track of the plunger assembly according to the cutaway 100 of FIG. 7*a;*
Figure 7C:
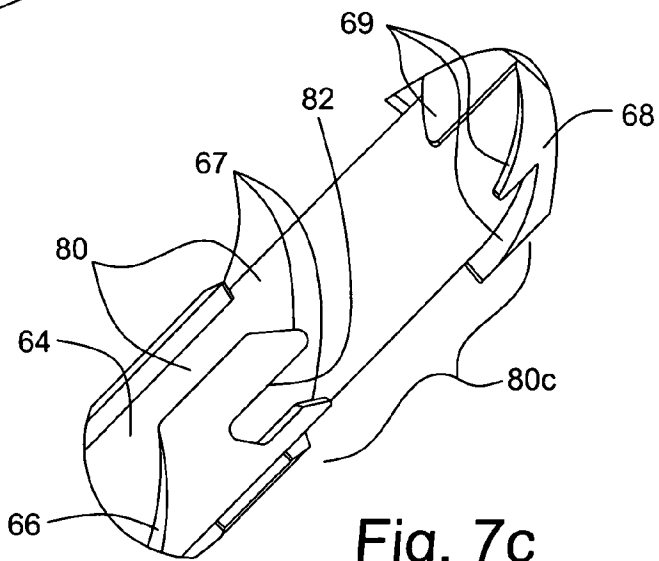
FIG. 7*c* is a side view of the upper profiled track according to cutaway 200 of FIG. 6*c;*
Figure 7D:
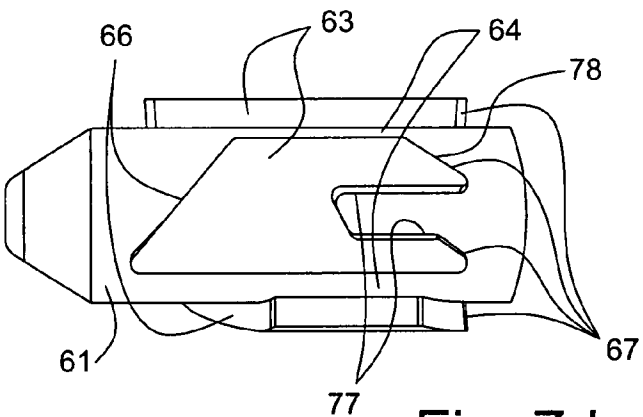
FIG. 7*d* is a partial side view of the lower profiled track according to the cutaway 300 of FIG. 6*c;*

In FIG. 8, one generic embodiment of a dog 70 and downhole cam 67 are shown. This embodiment permits application of torque in one direction only as the first and second rotation stops 81,82 are unidirectional. In an optional embodiment, as shown in FIGS. 5*b*, 6*c* and 9*c* second rotational stop 82 is a pocket 82*p* forming a bidirectional stop, having axial faces 77 for engaging the extended key 73, with its parallel edges 74, in both directions. This arrangement enables torque in both directions. Further, the extended key 73 provides greater surface area and greater torque capability.

In a third action from D to E, as shown further in the general case of FIG. 8, when it is desirable to manipulate the plunger 61 to the released position such as to disengage the rotor 13 from the bearing assembly 14 and to trip the rotor out of the wellbore, one applies set down or downhole force to move the plunger 61 downhole, guiding each dog's leading edge 71 for contact with the uphole cam 69 at E, causing indexed relative rotation to a third rotational stop 83 which misaligns each dog 70 from the second rotational stop 82 and aligns each dog 70 with an angled discharge face 78 on each segment's downhole cam 67.

In a fourth action, at F, uphole movement of the plunger 61 aligns each dog 70 once again with each entrance 64 for release of each dog from the track 80 wherein each dog 70 and the plunger 61 telescope out of the latch housing 60 to be released at G.

Figure 12:
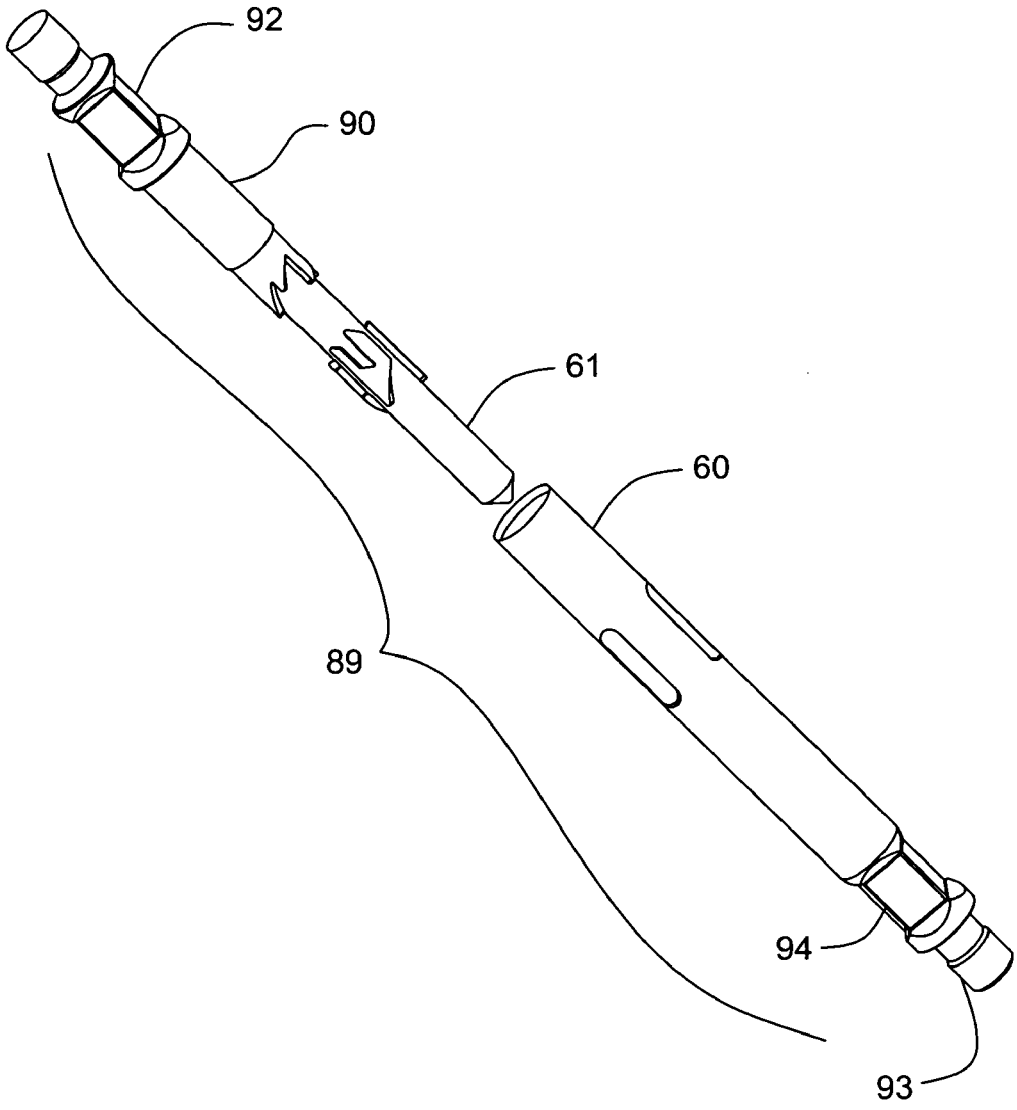
FIG. 12 is a perspective view of a male and female latch prior to coupling, the plunger and the housing being arranged for more generic connection with their respective components, threaded ends and wrench flats being provided for both.

Turning to FIG. 12, in another more universal embodiment of a releasable coupling, a latch assembly 89 is illustrated comprising the described plunger 61 and the latch housing 60. The plunger 61 is adapted with a more generic connector 90 having, threaded ends 91 and wrench flats 92 being provided. Similarly, the latch housing 60 is similarly fitted with threaded ends 93 and wrench flats 94. In greater detail in FIGS. 13*a*–13*e*, such as generic latching assembly is provided illustrating the equivalent implementation of the dogs 70, segments 63 and cam profiles 67,69 although the uphole and downhole cam designations need not apply, the assembly being operable in either orientation.

Figure 14:
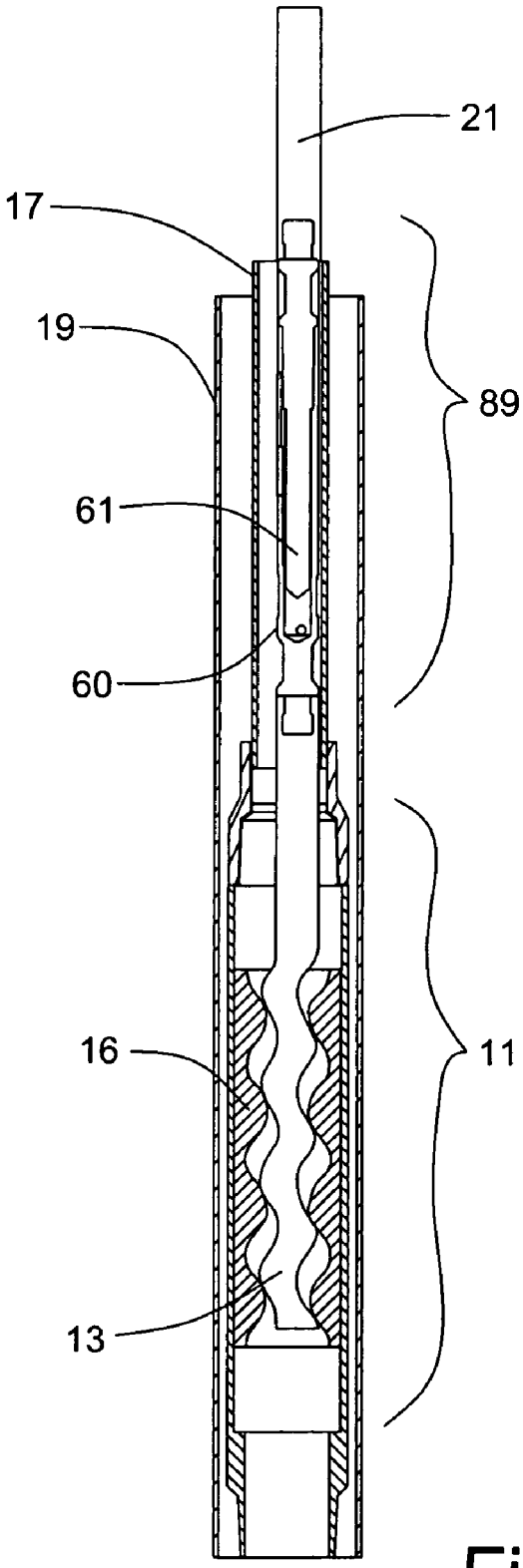
FIG. 14 is a schematic view illustrating an implementation of the latch for releasably coupling with an oversize rotor for driving the rotor in a pump stator at the end of a tubing string.
Figure 15:
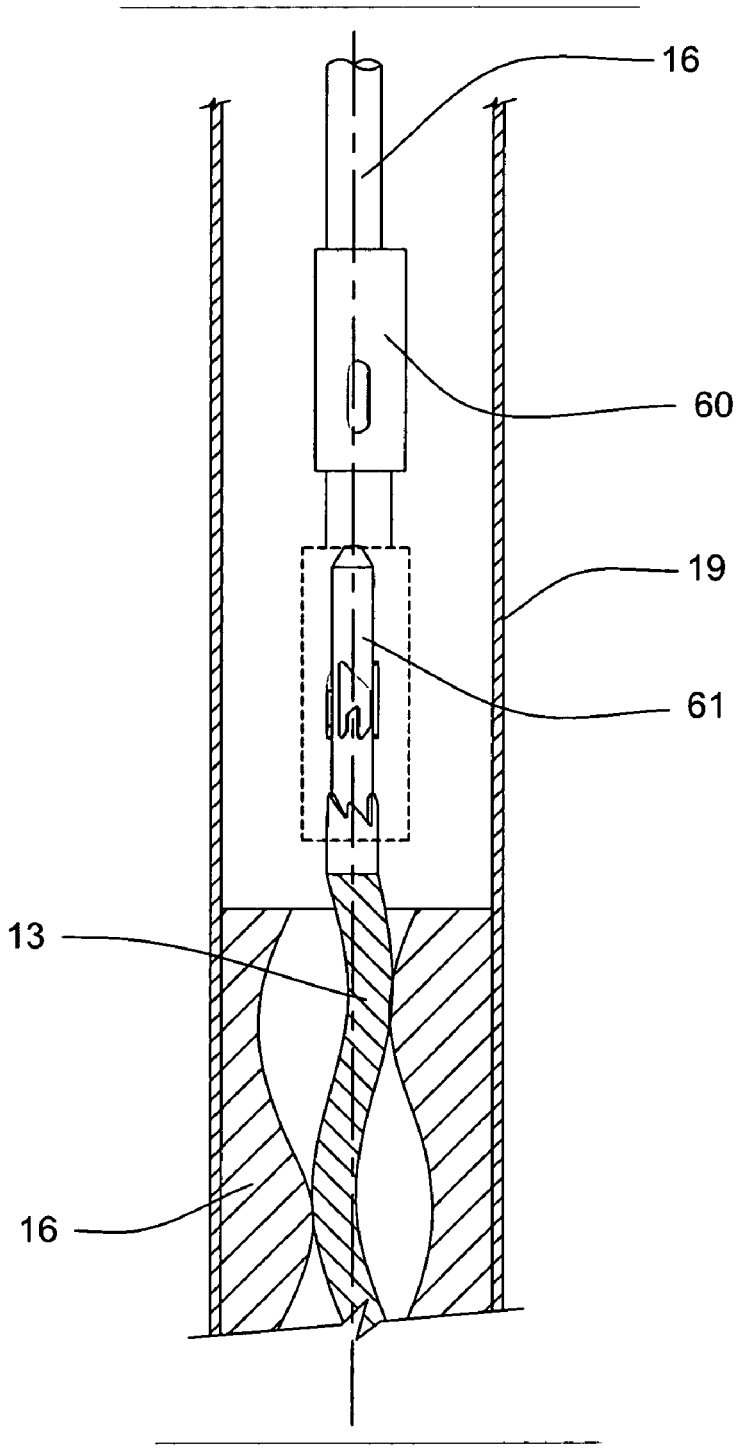
FIG. 15 is an optional embodiment with the latch housing connected to a rod string and the plunger connected to the top of a PC Pump rotor, all of the description associated with FIG. 8 being applicable if uphole/downhole are inversed.

With reference to FIG. 14, an implementation of the latch assembly 89 is illustrated in a PC Pump situation which could apply the latch assembly 89 in either orientation whether the pump is pumping liquids uphole or downhole. There is no longer any requirement to connect the rotor to any specific one of the well components as both the plunger 61 and latch housing 60 remain above the PC Pump and are not diameter-restricted. In this embodiment, the latch assembly 89 is required to convey torque from the drive string 21 to the rotor. As shown in FIG. 15, in a further illustration of the flexibility of the latch invention, the plunger 61 is shown as depending from the drive string 21 and the latch housing 60 is connected to the rotor 13.

The embodiments of the invention for which an exclusive property or privilege is claimed are defined as follows:

1. Apparatus in the casing of a wellbore for injecting liquid to a lower formation with a PC Pump having a rotor, comprising:

a packer set in the casing above the formation and adapted for pumping liquids, from uphole of the packer, downhole through the PC Pump and into the lower formation; and a bearing assembly positioned downhole of the PC Pump and spaced from the stator, a shaft connected to the rotor and bearings for rotatably supporting and axially restraining the rotor to the bearing assembly so that as the PC Pump rotor rotated to pump liquid through the stator from above the packer to the formation below the packer, uphole loads acting on the rotor are restrained through the bearing assembly.

2. The apparatus of claim 1 wherein the bearing assembly further comprises a releasable coupling between the shaft and the rotor.

3. The apparatus of claim 1 wherein the releasable coupling comprises:

a first connection depending from the rotor;

a second connection extending from the shaft; and cooperative means between the first and second connections.

4. The apparatus of claim 3 wherein a pony shaft is connected between the first and second connection.

5. The apparatus of claim 3 wherein the second connection further comprises a housing having a bore; and the first connection further comprises a plunger so that when the plunger engages the bore of the housing the first and second connection become coupled.

6. The apparatus of claim 5 further wherein the plunger and the housing form a latch operable between two positions:

a first position wherein the first and second connections are coupled; and a second position wherein the first and second connections are released.

7. The apparatus of claim 6 wherein the latch further comprises:

one or more dogs formed in the bore of the housing, and a track formed on the plunger and operable with a first axial movement to capture the dog for coupling the first and second connections and operable with a second axial movement to release the one or more dogs for uncoupling the first and second connections.

8. The apparatus of claim 6 wherein the latch further comprises: one or more dogs on the plunger; and a track formed in the bore of the housing and operable with a first axial movement to capture the dog for connecting the first and second connections and operable with a second axial movement to release the one or more dogs for uncoupling connecting the first and second connections.

9. The apparatus of claim 6 further comprising a pup-joint spacing the stator from the bearing assembly and having perforations formed therein for directing pumped fluids into the wellbore for injection into the lower formation.

10. The apparatus of claim 9 further comprising a one-way valve located below the pup-joint perforations and above the lower formation.

11. The apparatus of claim 1 wherein the bearings of the bearing assembly are sealed from the pumped liquids.

12. The apparatus of claim 11 wherein the shaft extends through a bore in the housing and the bearings rotatably support the shaft from the housing, the bearing assembly further comprising:

an uphole seal for sealing between the rotatable shaft and the housing; and a downhole seal for sealing the bore of the housing so as to protectively sandwich the bearings therebetween.

13. The apparatus of claim 11 wherein:

the uphole seal further comprises a first seal face sealed and rotatable with the shaft and biased to rotatably seal against a second seal face supported by and sealed to the housing.

14. The apparatus of claim 11 wherein the downhole seal further comprises:

a piston in the bore of the housing and having annular seals therebetween; and a spring biasing the piston downhole so that the piston is sealably slidable in the bore for equalizing pressure between the formation and the bore.

15. The apparatus of claim 1 further comprising a pup-joint spacing the stator from the bearing assembly and having perforations formed therein for directing pumped fluids into the wellbore for injection into the lower formation.

16. The apparatus of claim 15 further comprising a one-way valve located below the pup-joint perforations and above the lower formation.

17. A method for injecting liquid from a wellbore into a lower formation with a PC Pump having a rotor and a stator, comprising:

anchoring the packer in the wellbore above the lower formation;

rotating the rotor for pumping liquids from uphole of the packer downhole through the PC Pump and into the lower formation; and supporting the rotor with a bearing assembly positioned downhole of the PC Pump and spaced from the stator.

* * * * *